United States Patent [19]

Falwell et al.

[11] Patent Number: 4,862,543

[45] Date of Patent: Sep. 5, 1989

[54] WATERBED FOOTRAIL CAP

[76] Inventors: Bobby R. Falwell, Rte. 7, Box 696, Murray, Ky. 42071; Orval H. Wooley, 7301 Annie La., Paducah, Ky. 42001

[21] Appl. No.: 156,249

[22] Filed: Feb. 16, 1988

Related U.S. Application Data

[63] Continuation-in-part of Ser. No. 44,607, May 1, 1987, Pat. No. 4,724,561.

[51] Int. Cl.[4] ..... A47C 21/00; A47C 31/00

[52] U.S. Cl. ..... 5/508; 5/424

[58] Field of Search ..... 5/451, 400, 424, 282 R, 5/508; 248/345.1; 403/403, 232.1

[56] References Cited

U.S. PATENT DOCUMENTS 4,109,887 8/1978 Wakeland, Jr. ..... 5/451

4,724,561 2/1988 Falwell et al. ..... 5/424

OTHER PUBLICATIONS

"Horizon Manufacturing", a photo on p. 58 of the 12/84 issue of *Waterbed Magazine.*

*Primary Examiner*—Alexander Grosz

*Attorney, Agent, or Firm*—Mark J. Patterson

[57] ABSTRACT

A padded cap for the footrail of a waterbed frame comprises a cushioned member, a support member, and a mounting bracket adapted for transmitting loads to both the cap and rail.

2 Claims, 2 Drawing Sheets

WATERBED FOOTRAIL CAP

This is a continuation in part of application Ser. No. 044,607, filed May 1, 1987 and to be issued on Feb. 16, 1988 as U.S. Pat. No. 4,724,561.

BACKGROUND OF THE INVENTION

The present invention relates to a padded cap for use on the footrail of a waterbed frame.

Although waterbeds have become increasingly popular and sophisticated in their design, most still use a conventionally designed wooden frame to contain the water filled mattress. Campian, U.S. Pat. No. 4,625,351, describes on example of such a frame. A well-recognized problem with the typical waterbed frame is that the wooden rails are uncomfortable for the user while sitting or while entering or exiting the bed. Consequently, a variety of slip-on padded rail caps have been developed to address these problems. Examples are described by Fisher, U.S. Pat. No. 4,514,871; James, U.S. Pat. No. 4,554,039; Wakeland, U.S. Pat. No. 4,109,887; and Johenning, U.S. Pat. No. 4,197,602.

However, conventional footrail caps, commonly referred to in the industry as a "perch", have been unreliable in their overall construction and method of attachment to the footrail. Such caps are typically one- or two-piece units attached by a simple L-shaped bracket made of angle iron. In such a configuration, a significant portion of the load is transmitted directly and exclusively to the screws which secure the L-shaped bracket to the cap and rail, rather than being distributed throughout the cap and rail. What is needed, then, is a footrail cap which has mounting means adapted for distributing loads throughout the cap and rail to increase the strength and durability of the cap as a whole.

SUMMARY OF THE INVENTION

In the present invention, a planar cushioned member formed of foam-like material is bonded to a planar support member of particle board or similar rigid material. Mounting brackets with L-shaped and U-shaped ends are provided, with the U-shaped end fitting over the support member and between the support and cushion members. The L-shaped section of the bracket abuts the top and side surfaces of the footrail, being screw attached to the inside rail surface.

DESCRIPTION OF THE PREFERRED EMBODIMENT

Figure 1:
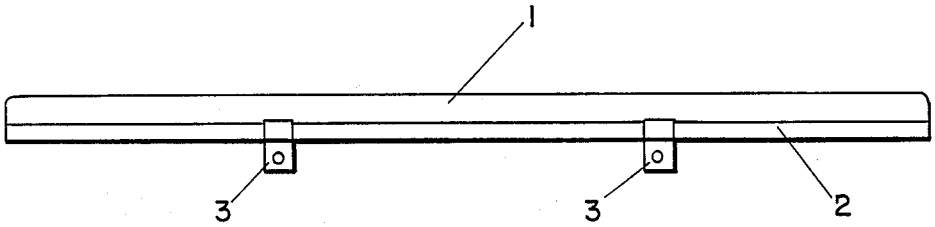
FIG. 1 is a lengthwise side view of the footrail cap.
Figure 2:
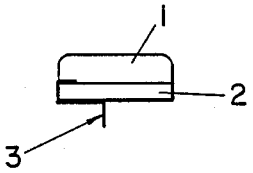
FIG. 2 is an end view of the footrail cap.
Figure 3:
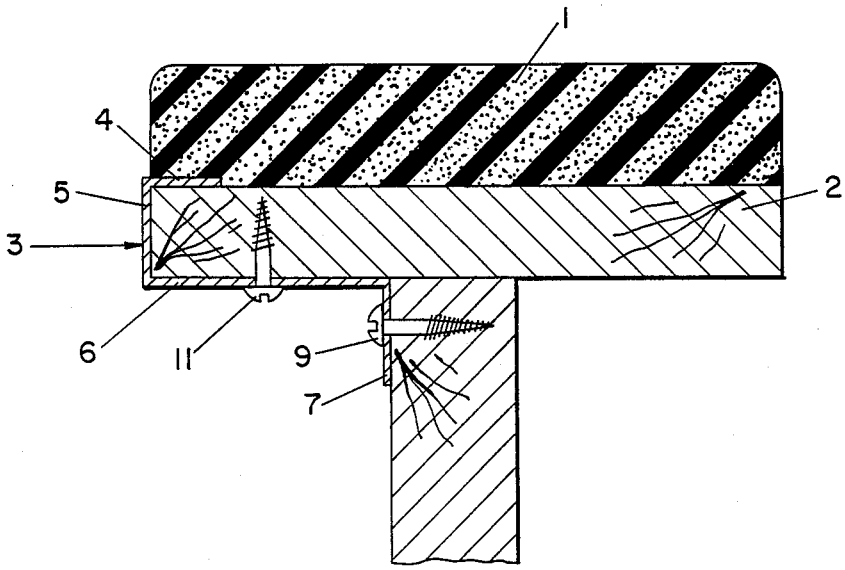
FIG. 3 is an enlarged cross-sectional view of the footrail cap mounted to a footrail.
Figure 4:
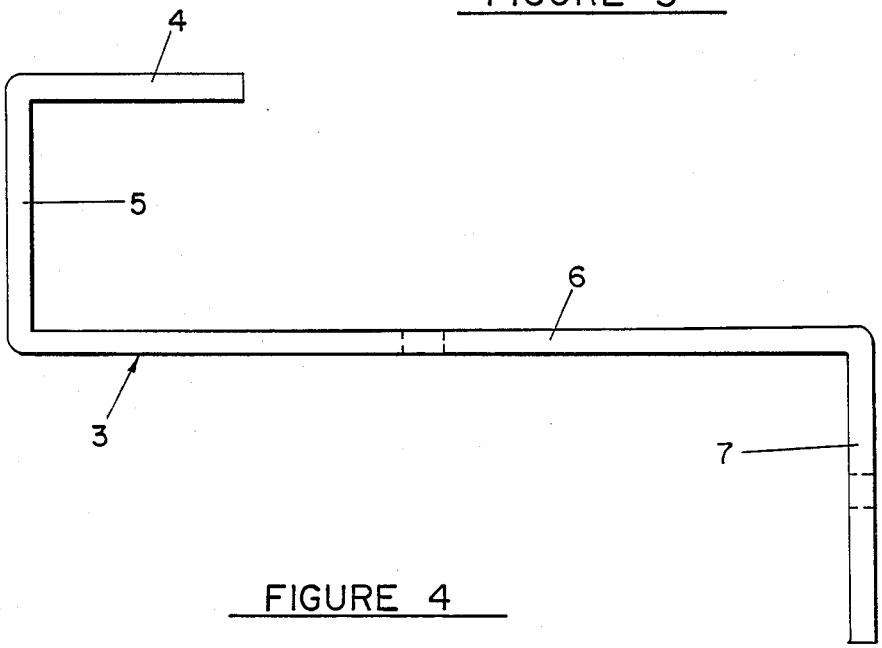
FIG. 4 is a enlarged view of the mounting bracket.
Figure 5:
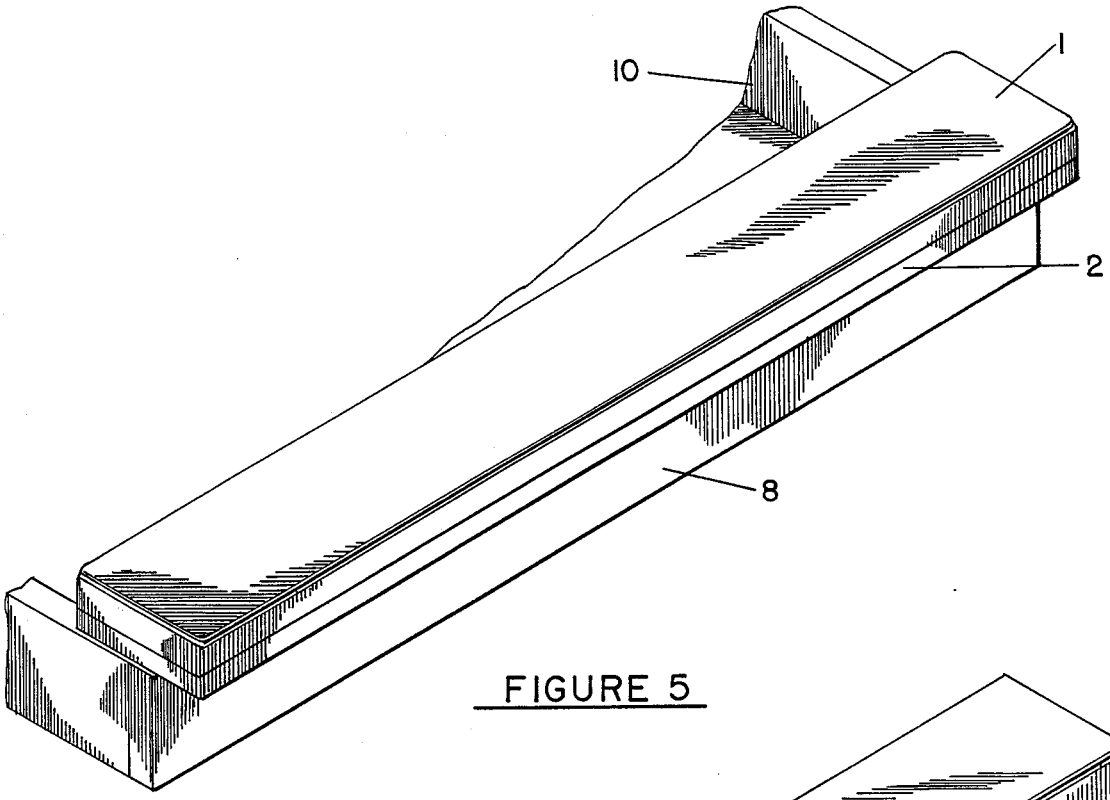
FIG. 5 is a perspective view of the footrail cap mounted to a waterbed frame.
Figure 6:
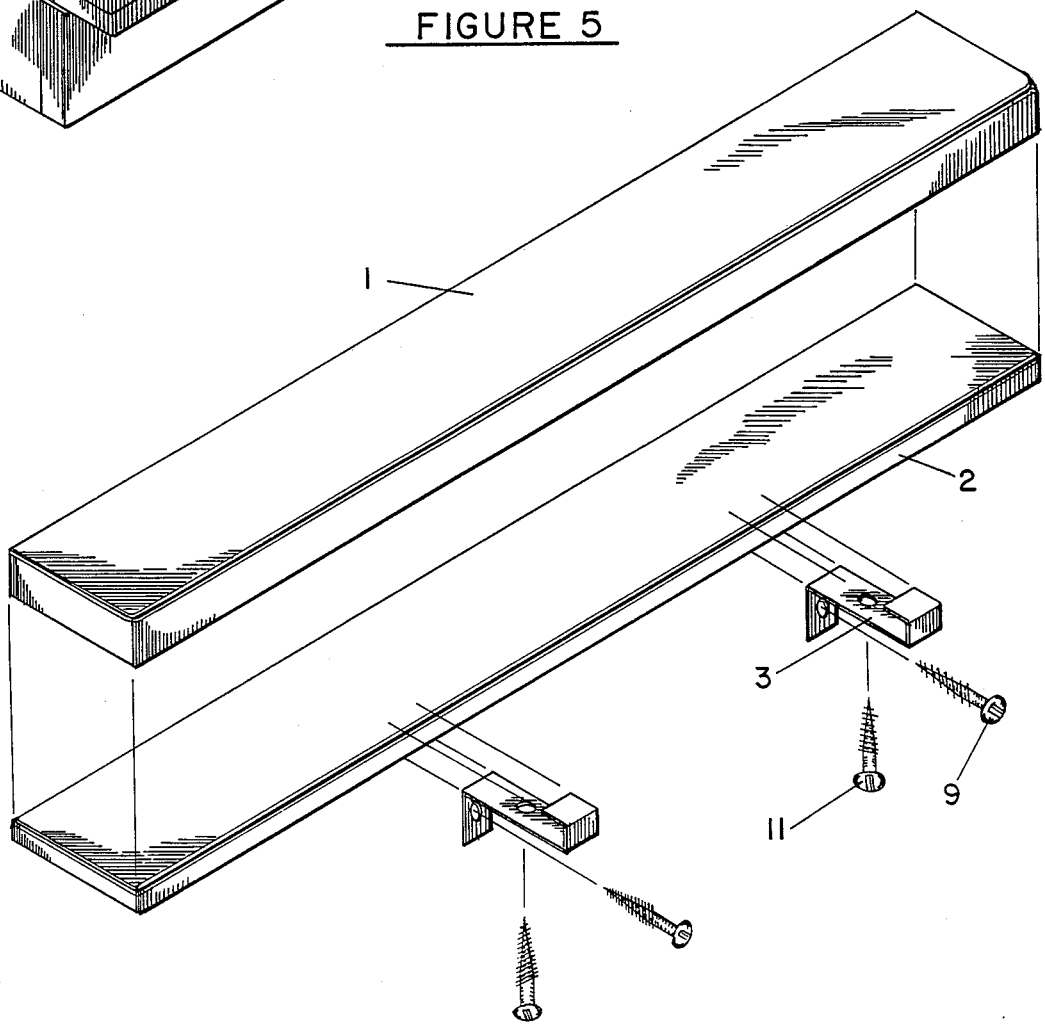
FIG. 6 is an exploded view of the footrail cap.

As best seen on FIGS. 3, 5, and 6, a waterbed footrail cap comprises cushion member 1, glued or otherwise bonded to support member 2, made of wood or wood products, and mounting bracket 3, mounted on footrail 8 of waterbed frame 10. Mounting bracket 3, comprising a U-shaped portion defined by sections 4, 5, and 6, and an L-shaped portion defined by sections 6 and 7, is fitted as shown, with section 4 placed between members 1 and 2. L-shaped section 7 is adapted for attachment by screw 9 to the inside vertical surface of footrail 8. Additional support is added by screw 11. Mounted as shown, the footrail cap effectively transmits the load of a person sitting on the cap throughout the cap and rail, rather than through merely the screws securing the typical L-shaped bracket.

What we claim is:

1. An improved cap for cushioning the footrail of a waterbed, having a cushioned member bonded to a support member, said improvement comprising a mounting bracket abutting said support member and abutting the inward facing surface of said footrail, with a portion of said bracket located between said cushion and support member.

2. The improved cap of claim 1 wherein said mounting bracket comprises:

a. an L-shaped portion abutting the lower surface of said support member and inward facing surface of said footrail; and b. a U-shaped portion partially abutting the lower and outside surfaces of said support member, with the distal section of said U-shaped portion located between said cushion and support members.

* * * * *